US005365872A

United States Patent [19]

Obrinski

[11] Patent Number: 5,365,872

[45] Date of Patent: Nov. 22, 1994

[54] REMOTE CONTROLLED MOORING SYSTEM

[76] Inventor: Bradley A. Obrinski, 47645 Jefferson, New Baltimore, Mich. 48047

[21] Appl. No.: 58,957

[22] Filed: May 7, 1993

[51] Int. Cl.[5] ..... B63B 21/00

[52] U.S. Cl. ..... 114/230; 114/218

[58] Field of Search ..... 114/230, 218, 253, 254, 114/245; 441/3-5

[56] References Cited

U.S. PATENT DOCUMENTS

| | | | |
|---|---|---|---|
| 3,640,560 | 2/1972 | Zawadzki . | |
| 3,760,422 | 9/1973 | Zimmer et al. . | |
| 3,879,709 | 4/1975 | Yukawa . | |
| 3,894,417 | 7/1975 | Taniyama . | |
| 4,079,690 | 3/1978 | Paul | 114/230 |
| 4,211,443 | 7/1980 | Butts et al. . | |
| 4,299,183 | 11/1981 | Prock | 114/230 |
| 4,531,470 | 7/1985 | Paul | 114/230 |
| 4,596,985 | 6/1986 | Bongard et al. . | |
| 4,602,253 | 7/1986 | Kreft . | |
| 4,697,537 | 10/1987 | Smith . | |
| 4,700,186 | 10/1987 | Fujino et al. . | |
| 4,820,330 | 4/1989 | Lin . | |
| 4,846,090 | 7/1989 | Palmquist | 114/230 |
| 4,866,961 | 9/1989 | Yang . | |
| 4,996,525 | 2/1991 | Becker, Jr. et al. . | |
| 5,083,448 | 1/1992 | Karkkainen et al. . | |

*Primary Examiner*—Stephen P. Avila
*Attorney, Agent, or Firm*—Peter D. Keefe

[57] ABSTRACT

An automatic mooring system for vessels utilizing a transmitter, a transmitter controlled connector assembly at the distal end of each mooring line and a transmitter controlled retraction assembly at the near end of each mooring line. The connector assembly includes a clasp equipped with a hinged gate which is normally locked in a closed position, but is openable in automatic response to a predetermined signal from the transmitter. This function is accomplished within the clasp by a solenoid operated release mechanism, a receiver wired to the solenoid, and a battery power pack for operating the aforesaid electronics. The retraction assembly is connected with the hull of the vessel and includes a reel that is springably biased to retract its associated mooring line, and is further regulated by a control mechanism. The control mechanism is operated in automatic response to the transmitter via a receiver, a solenoid wired with the receiver and an electrical supply for powering the aforesaid electronics. The transmitter is preferably portable, but may also be permanently located on the vessel. The transmitter may operate on the principle of any wireless signal transmission media such as, but not limited to, electro-magnetic radiation.

13 Claims, 3 Drawing Sheets

REMOTE CONTROLLED MOORING SYSTEM

BACKGROUND OF THE INVENTION

1. Field of the Invention

The present invention relates to mooring systems for vessels, and more particularly to a mooring system in which each mooring line thereof is equipped with a transmitter controlled clasp for remotely disengaging with respect to a stationary mooring member in response to actuation of a transmitter. Still more particularly, the present invention relates to a mooring system of the aforesaid class, further being equipped with transmitter controlled retraction of the mooring lines.

2. Description of the Prior Art

Vessels are moored utilizing mooring lines which connect between the vessel and stationary mooring members, such as for example, but not limited to, cleats or piles connected with a dock or pier. It is common practice to secure the mooring lines fore and aft of the vessel at at least one of the starboard or port sides of the vessel, preferably both. The connection of each mooring line to the vessel usually involves loop or knotted attachment to a respective cleat on the vessel, and connection to the respective stationary mooring member is usually accomplished by hand tying. These connections are time consuming, sometimes dangerous, and rather onerous, especially for pleasure craft operators.

In partial response to these problems, a retractable mooring line for vessels is described in U.S. Pat. No. 4,697,537 to Smith, dated Oct. 6, 1987. In this device, a spring loaded reel is provided in which a mooring line centrally exits from the vessel's deck and is thereupon unreeled so as to be secured to a stationary mooring member. When released from the stationary mooring member, the mooring line retracts via the spring action of the spring loaded reel. While Smith provides a retractable mooring line, there still remains the dangers and problems associated with its release from the stationary mooring member. And, this situation is aggravated by the location of the mooring line exit at the center of the deck of the vessel.

Accordingly, what is needed is a mooring line system which provides a plurality of mooring lines, located at the port and starboard sides of the bow and stern of the vessel so as to provide excellent moorage relative to stationary mooring members, and further which provides remote release of all mooring lines and retraction thereof thereafter.

SUMMARY OF THE INVENTION

The present invention is a mooring system for vessels utilizing a transmitter, a transmitter controlled connector assembly at the distal end of each mooring line and a transmitter controlled retraction assembly at the near end of each mooring line.

The connector assembly includes a clasp equipped with a hinged gate which is normally locked in a closed position, but is openable in response to a predetermined signal from the transmitter. This function is accomplished within the clasp by a solenoid operated release mechanism, a receiver wired to the solenoid, and a battery power pack for operating the aforesaid electronics.

The retraction assembly is connected with the hull of the vessel and includes a reel that is springably biased to automatically retract its associated mooring line, and is further regulated by a control mechanism. The control mechanism is operated responsively to the transmitter via a receiver, a solenoid wired with the receiver and an electrical supply for powering the aforesaid electronics.

The transmitter is preferably portable, but may also be permanently located on the vessel. The transmitter may operate on the principle of any wireless signal transmission media such as, but not limited to, electromagnetics.

Accordingly, it is an object of the present invention to provide a mooring system for a vessel in connection with stationary mooring members, in which connection with the stationary mooring members is regulated by wireless control.

It is an additional object of the present invention to provide a mooring system for vessels having mooring lines for connecting with stationary mooring members, in which connection of the mooring lines with the stationary mooring members is regulated by wireless control, and further in which the mooring lines are retractable with respect to the vessel in response to the wireless control.

It is another object of the present invention to provide a mooring system for vessels having mooring lines for connecting with stationary mooring members, in which connection of the mooring lines with the stationary mooring members is regulated by wireless control, and further in which the mooring lines are retractable with respect to the vessel in response to the wireless control, wherein the wireless control is provided via a mutually tuned transmitter and a receiver combination, at least one receiver, respectively, being located at each mooring line.

It is a further object of the present invention to provide a mooring system for vessels having mooring lines for connecting with stationary mooring members, in which connection of the mooring lines with the stationary mooring members is regulated by wireless control, and further in which the mooring lines are retractable with respect to the vessel in response to the wireless control, wherein the wireless control is provided via a mutually tuned transmitter and a receiver combination, at least one receiver, respectively, being located at each mooring line, and wherein at least one mooring line is provided at each of the starboard and port sides of the bow and stern of the vessel.

It is yet another object of the present invention to provide a mooring system for vessels having mooring lines for connecting with stationary mooring members, in which connection of the mooring lines with the stationary mooring members is regulated by wireless control, and further in which the mooring lines are retractable with respect to the vessel in response to the wireless control, wherein the wireless control is provided via a mutually tuned transmitter and a receiver combination, at least one receiver, respectively, being located at each mooring line, and wherein at least one mooring line is provided at each of the starboard and port sides of the bow and stern of the vessel, the mooring lines emanating from the gunwale of the vessel.

It is yet another object of the present invention to provide a mooring system for vessels having mooring lines for connecting with stationary mooring members, in which connection of the mooring lines with the stationary mooring members is regulated by wireless control, and further in which the mooring lines are retractable with respect to the vessel in response to the wireless control, wherein the wireless control is provided via a mutually tuned transmitter and a receiver combination, at least one receiver, respectively, being located at each mooring line, and wherein at least one mooring line is provided at each of the starboard and port sides of the bow and stern of the vessel, the mooring lines emanating from the gunwale of the vessel, and further wherein the retraction feature is structured for being fitted into new vessels or retrofitted into old vessels.

These, and additional objects, advantages, features and benefits of the present invention will become apparent from the following specification.

DETAILED DESCRIPTION OF THE PREFERRED EMBODIMENT

Figure 1:
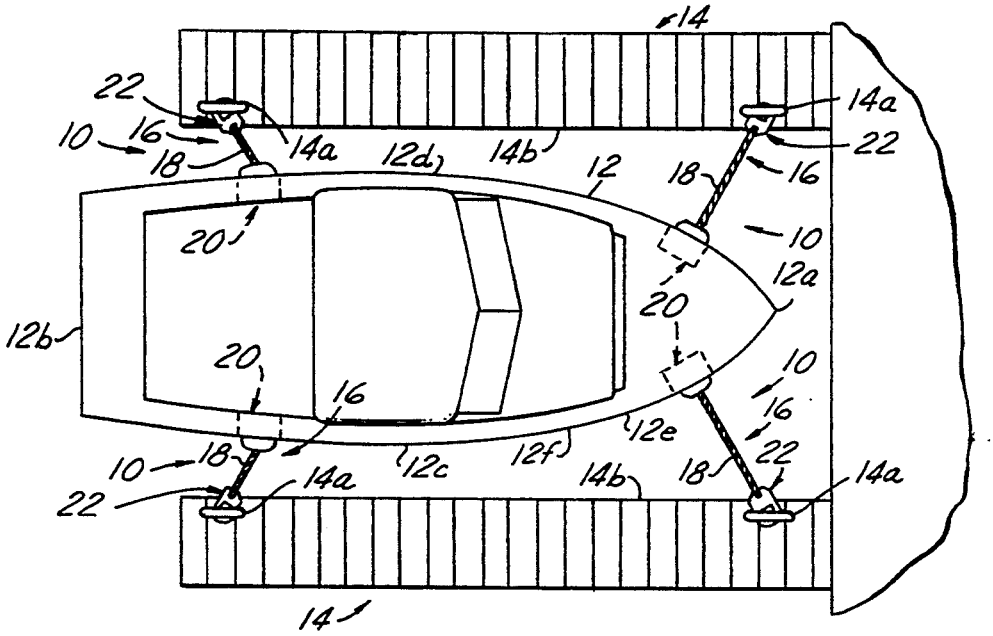
FIG. 1 is a plan view of a vessel moored to stationary mooring members via the mooring system according to the present invention.

Referring now to the Drawing, FIG. 1 shows the mooring system 10 according to the present invention connected with a vessel 12 and being utilized to moor the vessel with respect to stationary mooring members 14, wherein the stationary mooring members 14 are, by way of example, shown in the form of cleats **14*a* supported upon a dock 14*b*. It will be discerned from FIG. 1 that there are four mooring line units 16 which compose the mooring system 10. The location of the mooring units 16 is predetermined to render a safe and secure moorage with respect to the stationary mooring members 14. In the example shown, there are two mooring units 16 at each of the bow 12*a* and stern 12*b*, there further are two mooring units 16 on each of the starboard side 12*c* and the port side 12*d* of the vessel 12. Such a balanced distribution of mooring units 16 as shown in FIG. 1 provides a secure moorage for most vessels, such as pleasure craft. However, more or less than four mooring units 16 may be provided by the mooring system 10, as needed per the mooring requirements of a particular vessel. It will further be seen from FIG. 1 that each of the mooring units 16 emanates from the vessel 12 at the gunwale 12*e* thereof, thereby providing a more-or-less horizontal directionality for of the mooring lines 18 as between the vessel 12 and the cleats 14*a* of the stationary mooring members 14**.

Figure 2:
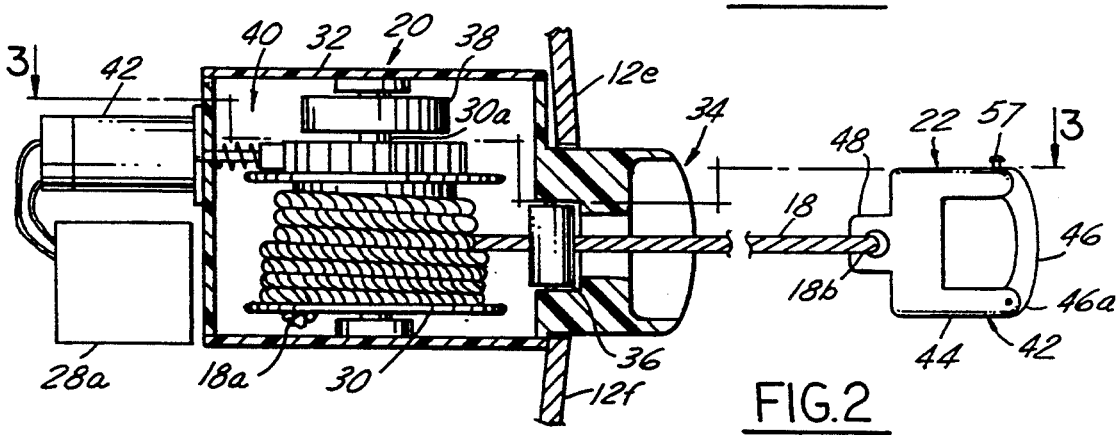
FIG. 2 is a partly broken, partly sectional side view of a mooring line unit of the mooring system according to the present invention.
Figure 3:
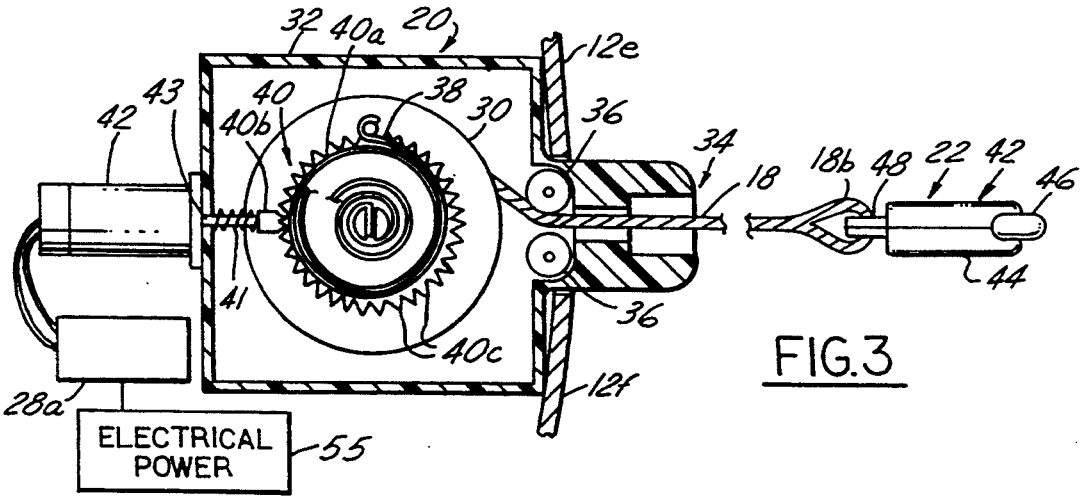
FIG. 3 is a partly broken, partly sectional plan view of a mooring line unit, seen along lines 3—3 in FIG. 2.
Figure 7:
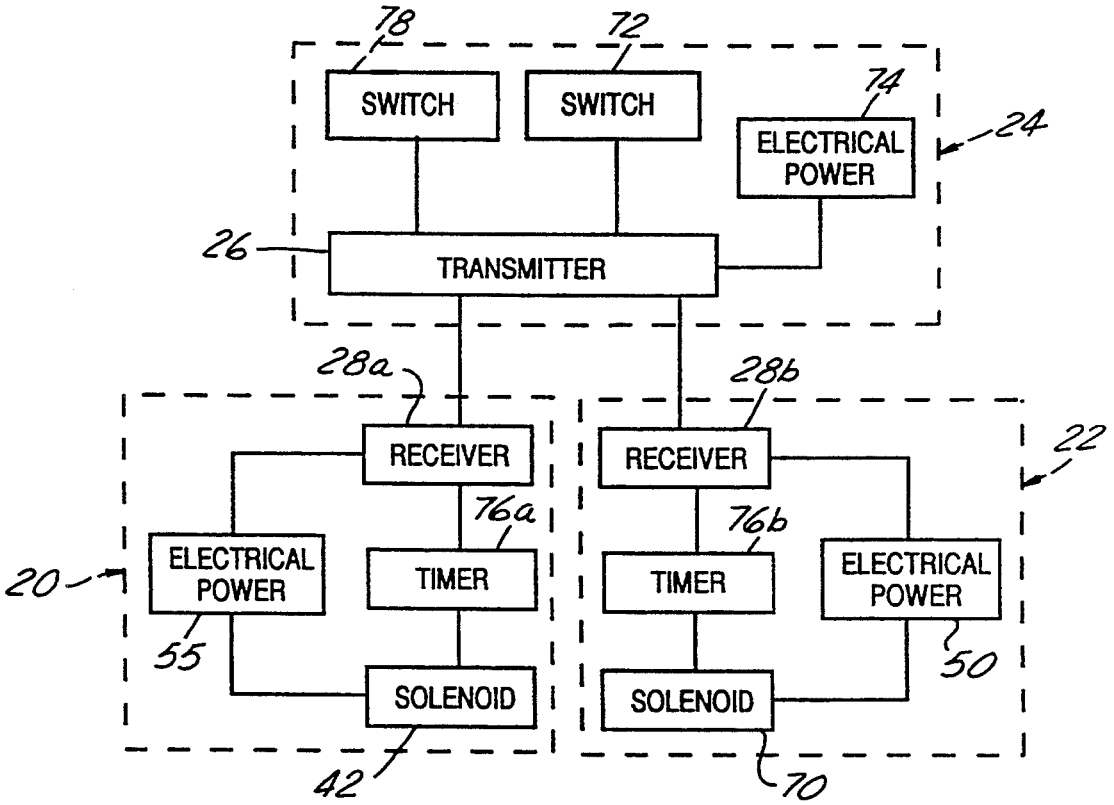
FIG. 7 is a schematic diagram of components for providing actuation of a mooring unit according to the present invention.

It will be further discerned from FIGS. 1, 2 and 7 that each mooring unit 16 of the mooring system 10 generally includes a retraction assembly 20 which is connected with the hull **12*f* of the vessel 12 (such as by bolting to a bulkhead, not shown), a mooring line 18, the near end 18*a* of which being connected with the retraction assembly, a connector assembly 22 connected to the distal end 18*b* of the mooring line 18, and a wireless transmitter 24. The wireless transmitter 24 includes a transmitter 26 which transmits a predetermined signal which is received by a receiver 28*a* in the retraction assembly 20 and by a receiver 28*b* in the connection assembly 22**, whereupon specific functions are executed in the manner discussed in detail hereinbelow.

The mooring line 18 is composed of any flexible, sturdy and weather resistant line utilized in the nautical arts, such as for example, but not limitation, nylon rope. The length thereof between its distal end **18*b* and its near end 18*a* is predetermined to amply provide connection between the hull 12*f* of the vessel 12 and a stationary mooring member 14. Because mooring circumstance may vary from one tie-up to the next, it is presumed a generous length of mooring line 18** would be provided.

The near end **18*a* of the mooring line 18 is connected with a reel 30 of the retraction assembly 20. In this regard, the reel 30 is rotatably mounted via an axle 30*a* to a housing 32, which is in turn connected by any well know fastener system to the hull 12*f* of the vessel 12, at a preselected location, preferably interior thereto at a bulkhead. Preferably, the housing and the chosen fastener system allow for fitting of the retraction assembly 20 to new vessels and for retrofitting the retraction assembly to existing vessels. A hull portal 34 permits entry of the mooring line 18 into the hull 12*f*. Roller bearings 36 are preferably provided at the hull portal 34 to ensure smooth reeling of the mooring line 18 relative to the reel 30. The hull portal 34 is preferably located at the gunwale 12*e* of the vessel 12**, although this is not a requirement.

Rotation of the reel 30 is influenced by a wind-up spring 38 which biasably connects between the housing 32 and the reel 30. The wind-up spring 38 provides a biasable retraction for any portion of the mooring line 18 which extends outside the hull portal 34. Biasable retraction of the mooring line 18 is, however, regulated by a control mechanism 40 composed of a toothed sprocket **40*a* connected with the reel 30 and a spring loaded pawl 40*b* connected with the housing 32. The pawl 40*b*, under bias of a spring 41, normally engages the teeth 40*c* of the sprocket 40*a* so as to prevent its rotation. A solenoid rod 43 of a solenoid 42 is connected with the pawl 40*b*, and when actuated, draws the pawl away from the teeth 40*c* sufficient to free the reel 30 to rotate. The solenoid 42 is actuated when the receiver 28*a* receives a predetermined signal from the wireless transmitter 24. Electrical power for the receiver 28*a* and the solenoid 42 would be preferably supplied from the vessel's electrical system 55**.

Since other configurations can be devised for providing the aforesaid control over mooring line retraction, such as providing a motor connected to the axle of the reel, or providing ramped teeth on the sprocket so as to permit one directional turning on the reel when the pawl engages the sprocket, the foregoing description is to be understood as being by way of preferred example only.

The distal end **18*b* of the mooring line 18 is connected to the connection assembly 22. The connection assembly 22 is composed of a clasp 42 which includes a substantially U-shaped base member 44, a gate 46 pivotally connected at a first end 46*a* thereof to the base member, and a mooring line connector 48** located on the base member opposite the gate.

The mooring line connector 48 preferably has the structure of an eyelet 48*a* for engaging with a permanent loop 18*c* at the distal end 18*b* of the mooring line 18, but this is not a requirement, as any structure which will suitably hold fast thereto the distal end 18*b* of the mooring line 18 is acceptable.

Figure 4:
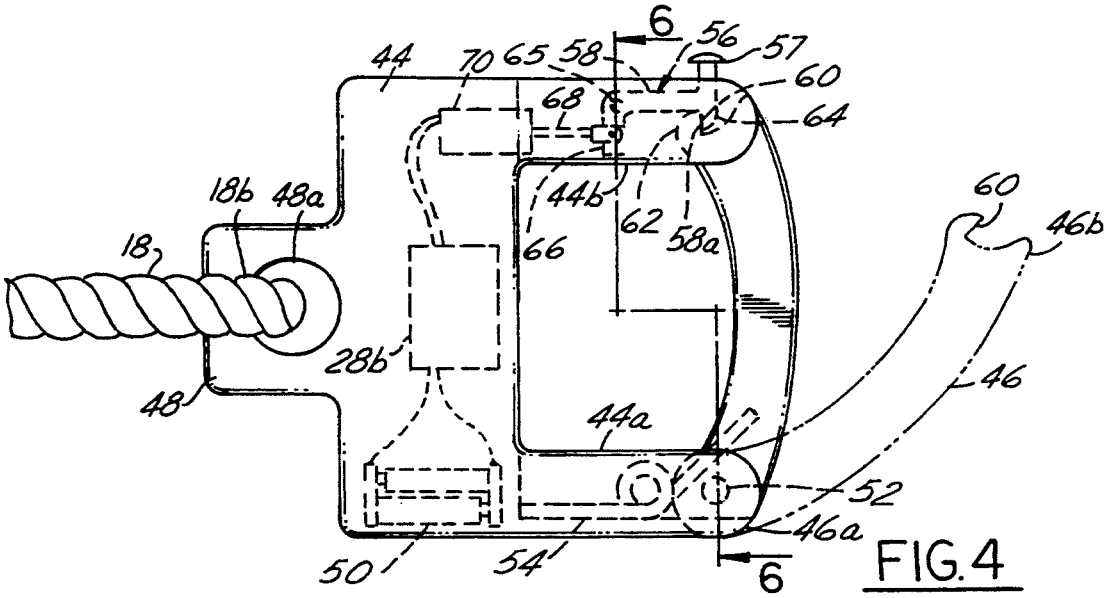
FIG. 4 is a plan view of the clasp of the mooring system according to the present invention, showing in phantom electro-mechanical components internal thereto.
Figure 5:
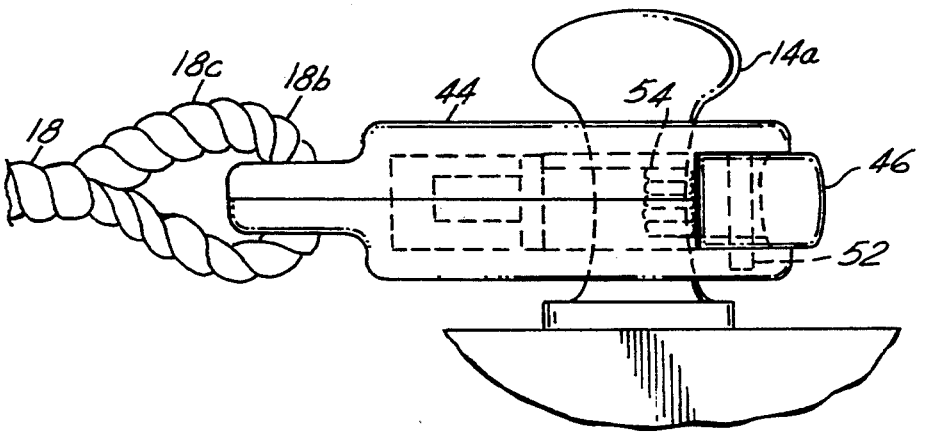
FIG. 5 is a side view of the clasp of the mooring system according to the present invention, shown connected with a stationary mooring member in the form of a cleat.
Figure 6:
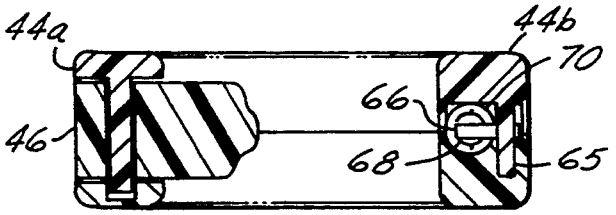
FIG. 6 is a partly sectional end view of the clasp of the mooring system, seen along lines 6—6 in FIG. 4.

The base member 44 contains mechanical and electrical components for effecting operation of the clasp 42, and further includes a first and second fork 44*a*, 44*b*. In this regard, as mentioned above, the gate 46 is pivotally connected via a pivot pin 52 to the base member 44 at the first end 46*a* at the first fork 44*a*. A spring 54 is provided at the pivot pin 52 in the first fork 44*a* for biasably urging the gate 46 into a closed configuration with respect to the first and second forks 44*a*, 44*b*, as shown in FIG. 4.

In order for the gate 46 to be selectively held against the second fork 44*b*, a release mechanism 56 is provided within the second fork. In this regard, an actuator arm 58 is pivotally mounted within the second fork 44*b*. The actuator arm 58 terminates in a hook 58*a* which is structured to interlock with a shoulder 60 on the second end 46*b* of the gate 46. A portion 64 of the actuator arm 58 and a portion 62 of the second end 46*b* of the gate 46 are both mutually rounded or beveled so that the force of the spring 54 acting on the gate 46 will cause the gate to slip into interlocking engagement with the actuator arm. A knob 57 is provided on the actuator arm 58 opposite the hook 58*a* for providing manual release of the hook with respect to the shoulder 60 whenever it is desired to manually open the gate 46.

The actuator arm 58 is further provided with a lever arm 66 at a pivot location defined by a pivot rod 65, the lever arm being perpendicularly oriented relative to the actuator arm. A solenoid rod 68 of a solenoid 70 is spring loaded and connects with the lever arm 66. When actuated, the solenoid 70 causes the actuator arm 66 to pivot away from the shoulder 60, thereby freeing the gate 46 to pivot on the pivot pin 52. The solenoid 70 is actuated when the receiver 28*b* receives the aforementioned predetermined signal from the wireless transmitter 24. Electrical power for the receiver 28*b* and the solenoid 70 is provided by a battery pack 50 located within the base member 44, and which is provided with an access port (not shown) for periodic battery replacement.

The wireless transmitter 24 utilizes any conventional type transmitter 26 which provides emission of one or more predetermined signals. The preferred media is the radio frequency band, but transmission can also be in the infrared, optical and microwave bands, another electro-magnetic band or another wireless media, such as sound. The wireless transmitter 24 is preferably a portable hand-held unit with a self-contained transmitter 26, switch 72 and battery pack 74, but alternatively, the transmitter 26 may be connected with the vessel 12 and/or be powered by the electrical system 55 of the vessel. The transmitter 26 transmits a predetermined signal which is uniquely tuned with respect to the receivers 28*a* and 28*b*. Accordingly, when the skipper presses the switch 72, the receivers 28*a*, 28*b* will respond, but not (within the limits of chance) other receivers on other vessels. Examples of existing, analogous and widely known wireless transmitter and receiver combinations are wireless garage door openers, wireless entry lock systems for automobiles and wireless alarm arming systems for automobiles.

Either or both the receivers can operate in conjunction with a timer 76*a*, 76*b* so as to keep the respective solenoids actuated for a preset period of time.

When docking the vessel 12, it is desirable for the reels 30 to be free to turn while the skipper moores each mooring unit 16. It is therefore preferable for the receiver 28*a* for the retraction assembly to have a dual signal reception capability and for the transmitter to be equipped with a dual signal transmission capability accessed by an auxiliary switch 78 and a main switch, wherein the main switch is the aforementioned switch 72 which is used now for casting-off. In this structure, the skipper presses the auxiliary switch 78 to effect release of the reels 30, then moores the mooring units 16, and then presses the auxiliary switch again to effect release of the pawls 40*b* so as to lock fast the sprockets 38. Alternatively, a separate auxiliary switch 78 for sending a separate frequency can be provided uniquely for each retraction assembly 20 (each receiver of each retraction assembly being uniquely tuned to a respective one of the preset signals). In this latter scenario, the main switch 72 would then broadcast all four signals when casting-off.

In operation, the skipper presses the switch on the transmitter to release the reels of each of the mooring lines. This function is facilitated if the transmitter is equipped with two or more switches, one or more auxiliary switches for the transmitter to send out a "stay open" signal to the solenoid of each of the retraction assemblies, and a main switch used for casting-off. The mooring lines are then pulled from their respective hull portals and secured to a respective stationary mooring member, such as a cleat. In this regard, if a separate auxiliary switch is provided for each mooring line, these are pressed in sequence as each mooring line is moored. Mooring of each mooring line is effected by the knob on the connection assembly being pulled so as to release the gate thereof so that the clasp can be placed onto a stationary mooring member. For example, the clasp may be placed over a cleat or the mooring line can be passed around a pile and then threaded back onto itself through the clasp. The gate is then closed on the forks, thereby providing an included space of the clasp for securing the mooring line to the stationary mooring member. After mooring is completed the auxiliary switch (or each switch in completed sequence if more than one is provided) is again pressed to cause the control mechanism to steadfastly engage the reels.

When the skipper wishes to cast-off, he or she simply presses the main switch, thereby releasing the gates and the sprockets. The reels now reel-in the mooring line under biasing of the wind-up springs as the clasps slip off the cleats. The mooring lines continue reeling-in the mooring line until the clasps engage their respective hull portal.

Regulation of actuation of the solenoid of the retraction assembly may be optionally accomplished by a timer 76*a* (see FIG. 7) which is preset to allow ample time for reeling-in of the mooring line to be effected before switching-off the solenoid. Alternatively, shut-off can be effected by a sensing switch (not shown) at the hull portal which effects shut-off of the solenoid when the connection assembly seats with the hull portal.

To those skilled in the art to which this invention appertains, the above described preferred embodiment may be subject to change or modification. For instance, the retraction assembly can be fully mechanical in operation, having no receiver thereat for control by the wireless transmitter. Such change or modification can be carried out without departing from the scope of the invention, which is intended to be limited only by the scope of the appended claims.

What is claimed is:

1. A mooring system for mooring a vessel to at least one stationary mooring member, said mooring system comprising:

transmitter means for providing emission of at least one predetermined wireless signal; and at least one morning line unit connected with the vessel, each mooring line unit of said at least one mooring line unit comprising:

a mooring line having a near end and a distal end;

mooring line connection member means entirely connected to said distal end of said mooring line for providing selective connection of said mooring line with respect to a stationary mooring member responsive to emission of said at least one predetermined wireless signal; and connector assembly means for connecting said near end of said mooring line to the vessel, said connector assembly means comprising:

a housing connected to the vessel;

reel means connected with said housing and said near end of mooring line for providing reelable storage of said mooring line;

retraction means connected with said reel means for providing retraction of said mooring line with respect to the vessel reelably upon said reel means; and control mechanism means for providing selective control over actuation of said retraction means responsive to emission of said at least one predetermined wireless signal;

wherein said at least one predetermined signal emitted from said transmitter means actuates said control mechanism means so as to cause said retraction means to effect retraction of said mooring line on said reel means, and substantially simultaneously actuates said mooring line connection member means so as to release said distal end of said mooring line from connection with the stationary mooring member.

2. The mooring system of claim 1, wherein said mooring line connection member means comprises:

a clasp comprising:

a base member connected with said distal end of said mooring line, said base member having a first fork and a second fork;

a gate having a first end and a second end, said first end of said gate being pivotally connected with said first fork; and mooring line connector means connected with said base member for connecting said distal end of said mooring line thereto; and release mechanism means connected with said second fork for selectively holding said second end of said gate to said second fork responsive to emission of said at least one predetermined signal;

wherein said base member, said first fork, said second fork and said gate provide an included space for connecting said clasp with respect to the stationary mooring member.

3. The mooring system of claim 2, wherein said retraction means comprises a wind-up spring connected with said housing and said reel means; further wherein said control mechanism means comprises:

sprocket means connected with said reel for providing a plurality of teeth;

a pawl slidably mounted to said housing for selectively engaging said plurality of teeth, said pawl preventing said reel means from rotating when engaged with said plurality of teeth;

pawl bias means for biasing said pawl into engagement with said plurality of teeth;

first solenoid means for selectively withdrawing said pawl from engagement with said plurality of teeth;

first receiver means for actuating said first solenoid means responsive to emission of said at least one predetermined signal from said transmitter means; and first electrical power means connected with at least one of said housing and the vessel for electrically powering said first solenoid means and said first receiver means.

4. The mooring system of claim 3, wherein said mooring line connection member means further comprises gate bias means connected to said first fork and said first end of said gate for biasing said second end of said gate toward said second fork; further wherein said release mechanism means comprises:

actuator means connected with said base member for selectively engaging said second end of said gate so as to selectively hold said second end of said gate at said second fork;

second solenoid means for selectively disengaging said actuator means from said second end of said gate;

second receiver means for actuating said second solenoid means responsive to emission of said at least one predetermined signal from said transmitter means; and second electrical power means connected with said base member for electrically powering said second solenoid means and said second receiver means.

5. The mooring system of claim 4, wherein the vessel has a hull, the hull having a gunwale; said mooring system further comprising hull portal means connected with said housing for providing an exit portal of said mooring line through the hull of the vessel substantially at the gunwale.

6. The mooring system of claim 5, wherein each first receiver means of said at least one mooring unit uniquely responds to a respective first predetermined signal of said at least one predetermined signal emitted by said transmitter means, wherein each first and second receiver means of said at least one mooring line unit responds to a second predetermined signal of said at least one predetermined signal emitted from said transmitter means.

7. The mooring system of claim 5, wherein the vessel has a starboard side, a port side, a bow and a stern; wherein said at least one mooring line unit comprises at least four said mooring line units, a first mooring line unit being provided at the starboard side stern of the vessel; a second mooring line unit being provided at the starboard side bow of the vessel; a third mooring line unit being provided at the port side bow of the vessel; and a fourth mooring line unit being provided at the port side stern of the vessel.

8. The mooring system of claim 6, wherein each first receiver means of said at least four mooring units uniquely responds to a respective first predetermined signal of said at least one predetermined signal emitted by said transmitter means, wherein each first and second receiver means of said at least four mooring line units uniquely responds to a second predetermined signal of said at least one predetermined signal emitted from said transmitter means.

9. The mooring system of claim 2, wherein said mooring line connection member means further comprises gate bias means connected to said first fork and said first end of said gate for biasing said second end of said gate toward said second fork; further wherein said release mechanism means comprises:

actuator means connected with said base member for selectively engaging said second end of said gate so as to selectively hold said second end of said gate at said second fork;

solenoid means for selectively disengaging said actuator means from said second end of said gate;

first receiver means for actuating said solenoid means responsive to emission of said at least one predetermined signal from said transmitter means; and electrical power means connected with said base member for electrically powering said solenoid means and said first receiver means.

10. The mooring system of claim 9, wherein the vessel has a hull, the hull having a gunwale; said mooring system further comprising hull portal means connected with said housing for providing an exit portal of said mooring line through the hull of the vessel substantially at the gunwale.

11. The mooring system of claim 10, wherein said control mechanism means of each mooring line unit of said at least one mooring line unit has a second receiver means for actuating said control mechanism means responsive to receiving a respective first predetermined signal of said at least one predetermined signal emitted by said transmitter means, wherein each first and second receiver means of said at least one mooring line unit responds to a second predetermined signal of said at least one predetermined signal emitted from said transmitter means.

12. The mooring system of claim 10, wherein the vessel has a starboard side, a port side, a bow and a stern; wherein said at least one mooring line unit comprises at least four said mooring line units, a first mooring line unit being provided at the starboard side stern of the vessel; a second mooring line unit being provided at the starboard side bow of the vessel; a third mooring line unit being provided at the port side bow of the vessel; and a fourth mooring line unit being provided at the port side stern of the vessel.

13. The mooring system of claim 12, wherein said control mechanism means of each mooring line unit of said at least one mooring line unit has a second receiver means for actuating said control mechanism means responsive to receiving a respective first predetermined signal of said at least one predetermined signal emitted by said transmitter means, wherein each first and second receiver means of said at least four mooring line units uniquely responds to a second predetermined signal of said at least one predetermined signal emitted from said transmitter means.

* * * * *